United States Patent [19]

Castellanos

[11] Patent Number: 4,732,385

[45] Date of Patent: Mar. 22, 1988

[54] ROULETTE FOR GAMING

[76] Inventor: Rodolfo B. Castellanos, Escalmendi, 11, Vitoria, Spain

[21] Appl. No.: 903,499

[22] Filed: Sep. 3, 1986

Related U.S. Application Data

[63] Continuation-in-part of Ser. No. 726,348, Apr. 23, 1985, abandoned.

[51] Int. Cl.[4] ..... A63F 5/02

[52] U.S. Cl. ..... 273/142 B; 273/142 E

[58] Field of Search ..... 273/142 R–142 G, 273/143 R

[56] References Cited

U.S. PATENT DOCUMENTS

| | | | |
|---|---|---|---|
| 518,726 | 4/1894 | Roever | 273/142 E X |
| 1,442,651 | 9/1921 | Cory | 273/142 E |
| 4,036,497 | 7/1977 | Garto et al. | 273/142 B X |
| 4,396,193 | 8/1983 | Reinhardt et al. | 273/142 B |
| 4,643,425 | 2/1987 | Herzenberger | 273/142 B |

FOREIGN PATENT DOCUMENTS

| | | | |
|---|---|---|---|
| 0046306 | 8/1981 | European Pat. Off. | 273/142 R |
| 2609169 | 9/1976 | Fed. Rep. of Germany | 273/142 B |
| 8204804 | 12/1982 | Netherlands | 273/142 F |
| WO83/2904 | 9/1983 | PCT Int'l Appl. | 273/142 E |
| 2042233 | 9/1980 | United Kingdom | 273/143 R |
| 2061585 | 5/1981 | United Kingdom | 273/143 R |
| 2073467 | 10/1981 | United Kingdom | 273/143 R |
| 2126108 | 3/1984 | United Kingdom . | |

*Primary Examiner*—Paul E. Shapiro

*Attorney, Agent, or Firm*—Lucas & Just

[57] ABSTRACT

A roulette for gaming, provided with a set of control and game choice displays, which includes a motor for spinning the body of the roulette where the ball rolls, and doing so at a speed that is capable of alteration, so that the ball is ejected from one slot and becomes lodged in another at random, and which furthermore includes sensors for detecting the position of the ball, for comparing it with the position staked, and for awarding a prize in the event of both being the same.

7 Claims, 4 Drawing Figures

FIG. 1
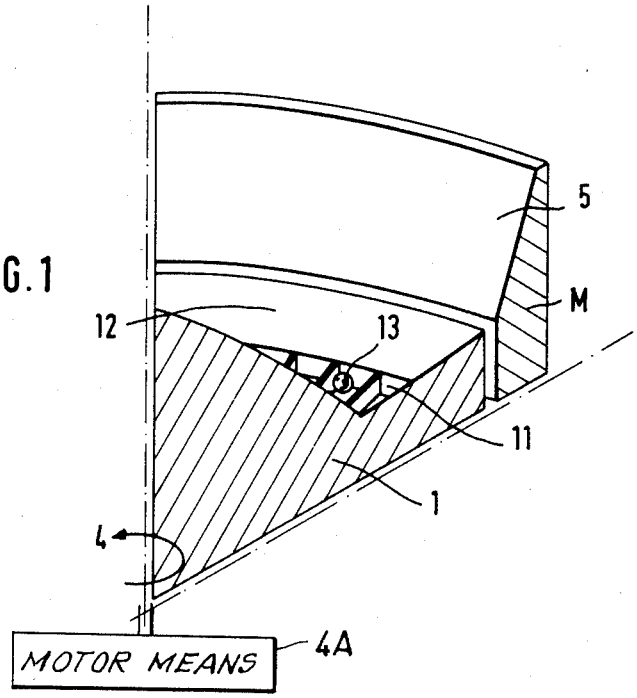
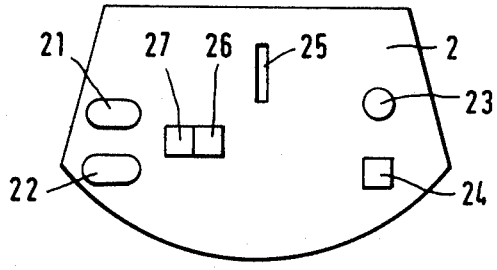
FIG. 2

FIG. 3
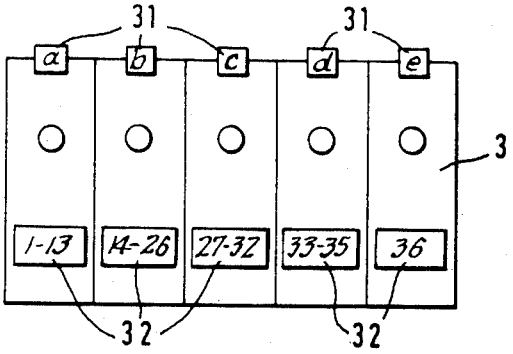
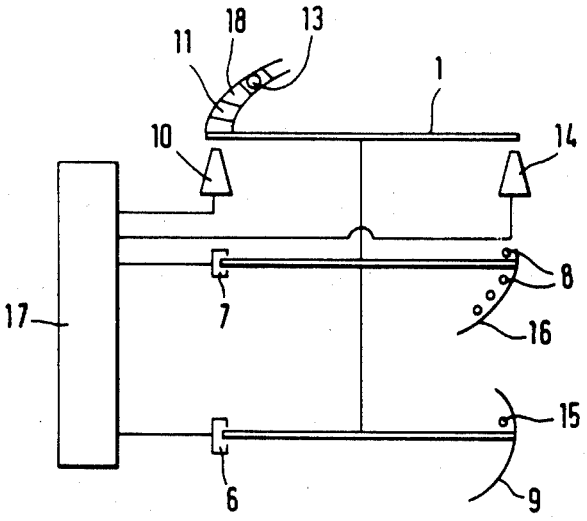
FIG. 4

ROULETTE FOR GAMING

This is a continuation-in-part of application Ser. No. 726,348 filed Apr. 23, 1985 and now abandoned.

This invention relates to a roulette gaming apparatus and more particularly to an apparatus for playing roulette without a croupier.

In the case of a casino roulette, a main body or roulette wheel which possesses slots is made to spin while the croupier throws the ball in the opposite direction onto a running rim which is bordered by a surrounding rim.

Both the running rim and the surrounding rim make up a single component that is integral with the gaming table, and are stationary in the case of a conventional roulette.

Broadly, the present invention comprises a roulette, a control panel and a gaming panel which allows the player to play the game of roulette without the need of a croupier.

Applicant has discovered that by changing the shape of the wheel and its configuration that a more random game is played.

Applicant has also discovered that the fun and excitement of playing the game of roulette is increased by having a means to increase the prize after the player has chosen the slot and the ball has started to spin but before the ball has come to rest in a slot.

Applicant has additionally discovered a new way to detect the location of the ball in a slot.

Applicant has also discovered that by varying or sharply dropping the speed of the wheel, the ball is set into motion around the wheel.

These and other novel aspects of the present invention will become apparent from reading the following detailed decription along with the drawings wherein:

FIG. 1 shows a partially sectioned diagrammatic and elevational view of the roulette.

FIG. 2 depicts a diagrammatic view of a player's control panel and the main components thereon.

FIG. 3 depicts a diagrammatic view of a player's gaming panel and the main components thereon.

FIG. 4 is a working diagram of the roulette.

In the case of a gaming machine of the present invention, there is no croupier to throw the ball, and it is therefore the machine itself which does so.

Turning to FIG. 1, the roulette of the present invention has roulette or main body 1 which spins in the direction of arrow 4 and is encircled by surrounding rim 5. Main body 1 has slots 11 and running rim 12. Slot 11 accommodates ball 13.

Roulette 1 possesses at least 36 slots 11, these being numbers from 1 to 36, although depending upon the internal laws in each country and upon the roulette gaming regulations, it may possess 36 slots plus a slot for zero, plus a slot for double zero, and so on.

In FIG. 1 ball 13 is already lying in slot 11 when the roulette starts to spin.

The roulette covered by this invention is equipped with motor means 4A for spinning roulette 1. Such motor means may be an electric motor with an associated programmed speed variator or any other conventional means such as any expert would be able to replace instead of its equivalent and which provides the roulette with its rotation speed.

In order to trigger the release of ball 13, motor means 4A makes the speed of roulette 1 drop sharply, or reverse its direction of rotation 4 so as to make ball 13 be released onto running rim 12 by virtue of the inertia of ball 13.

If the roulette were a conventional one used in a casino, ball 13, upon emerging from slot 11, would quickly impinge against surrounding rim 5 and tumble back into another slot close to the one from which it had just emerged from, thus severely interfering with the randomness of the game.

To prevent this from happening, the roulette covered by this invention embodies running rim 12 into roulette 1 and makes running rim 12 an extension of roulette 1 which has the effect of making ball 13 stay upon running rim 12 for a very much longer time indeed. This configuration ensures that ball 13 drops into one of the slots in a wholly random fashion.

Running rim 12 is preferably banked and in continuous prolongation from slots 11 so that the ball can enter and leave said slots with a greater degree of ease, although a corrugated or similar shaped rim may be used instead.

Surrounding rim 5 is preferably heavily banked and stationary, while the banking may slope either inwards or outwards.

FIG. 2 illustrates control panel 2 which has coin insertion slot 25; display 21 to show the machine is ready to play; display 22 to show that the machine will not accept further games; display 23 to show that the machine is not working; means 24 for holding the jokers displayed in joker display 31 in the position in which the jokers are displayed; display 26 to denote the number of games left to be played; and display 27 to show slot 11 where ball 13 has landed and for which slot a prize will be awarded.

FIG. 3 illustrates players gaming panel 3 which has game selectors 32 and joker displays 31.

There is a relationship between slot 11 and game selectors 32 Slots 11 whose numbers range from 1 to 13 are related to selector **32*a*, slots in the range from 14 to 26 are related to selector 32*b*, those in the range from 27 to 32 are related to selector 32*c*, slots in the range from 33 to 35 are related to selector 32*d*, and the slot numbered 36 is related to selector 32*e***.

With the construction as hereinbefore described, the game is conducted as follows. One or more coins are inserted in the slot 25, whereupon the number of games that can then be played is shown on display 26. The number of games shown on display 26 being dependent upon the amount of money inserted into the machine and the number of games already played. Roulette 1 is set spinning, in play, by motor means 4A and display 21 illuminates to denote that the machine is ready to play. Next, the player depresses one or more of buttons 32 as many times as games he wishes to play.

If a player wishes to place one's stake on the slot numbered 20, one must press selector **32*b*, and every time one presses selector 32*b***, one's stake is multiplied.

When display 22 is illuminated and display 21 is extinguished, it means that the machine wil now no longer take any bets, since ball 13 is about to come to rest in one of the slots 11.

When roulette 1 comes to rest, and ball 13 drops into a slot 11, whereafter display 27 illuminates to denote the slot where the prize has been awarded.

Let it be assumed that ball 13 came to rest in slot No. 10, this being related to selector **32*a*. In this case, since the player had pressed selector button 32*b***, he is not eligible for any prize.

Now let it be assumed that ball 13 came to rest in slot No. 18, which is related to selector button 32*b*. Here, in view of the fact that selector button 32*b* was pressed, the player is awarded a prize.

Before ball 13 comes to rest in slot 11, and depending upon the machine program, a joker may or may not appear suddenly on any of the joker displays 31 at random.

As soon as the player presses button 24, the joker will be held upon whichever display 31 the joker was in view at that time.

The player should endeavor to press button 24 when the joker is in view upon that display 31 which is opposite to whichever selector 32 he has chosen for his game.

Thus, for instance, if the player had chosen to place his bet on slot No. 35, he would have pressed selector button 32*d* and then would attempt to get the joker on display 31*d* by means of button 24.

There are two possibilities here. Either the player succeeds in getting the joker on display 31*d*, or he gets the joker on any other display 31.

Now let it be assumed that ball 13 falls into slot No. 34.

In the first of the two aforementioned possibilities, the player is given a special prize, and in the second he is awarded an ordinary prize. This special prize aspect of the present invention increases the fun and excitement of the game by providing a means to increase the prize after the player has chosen the slot and the ball has started to spin.

Roulette 1 possesses slot 11 which are numbered from 0 to 36, and may or may not possess small holes 18 according to whether detector 10 is a beam emitting detector or simply a detector to detect presence.

Integrally attached to roulette 1 is a first plate 9 that possesses a single hole 15 which is in line with the zero position of roulette 1, and associated to said first plate 9 is a first conventional infra-red beam transmitter/detector 6 which tells processor 17 whether the beam is received or not, which depends upon whether said beam is in line with hole 15.

When hole 15 comes into line with first transmitter/detector 6, processor 17 knows that roulette 1 is going by zero.

There is also a second plate 16 possessing as many holes 8 as there are slots 11 on the roulette, together with a second associated transmitter/detector 7.

When processor 17 receives the signal to show that the roulette is going by zero, it begins to count the impulses received from second transmitter/detector 7, these being one per slot, and since it is provided with a code which identifies the position of each slot with respect to zero by means of its relevant number, processor 17 knows precisely which slot is facing the transmitter/detectors.

A conventional type of detector 10 to detect presence, or some other kind of transmitter/detector faces slot 11 as it passes in front of same while roulette 1 is spinning.

If ball 13 happens to be in the slot facing detector 10, detector 10 will convey this information to the processor 17 which thereupon is in posession of all the information it needs in order to discover which slot the ball 13 is located in, and the number thereof, and it forthwith decides whether or not to award a prize according to whether said number is that upon which the player staked his money or not.

It is conceivable that because of its speed in motion, ball 13, after entering a certain slot and detector 10 informing processor 17 thereof, were thereafter to jump out of that slot and into the next one by reason of its inertia, this fact too being transmitted by detector 10 to processor 17, which then would be in a quandary as regards which slot is that which qualifies.

In order to avoid such a situation from arising, one or more detectors 14 are spaced at angles to one another, and since they perform an identical function to that of first detector 10, there data is transmitted to processor 17 which will decide in favor of that slot which is the one covered by the data coming from detectors 10, 14.

It will be understood that this application is intended to cover all modifications and changes of the preferred embodiments of the invention herein chosen for the purpose of illustration which do not constitute a departure from the spirit and scope of the invention.

What is claimed is:

1. An apparatus for playing roulette comprising:

(a) a roulette wheel provided with slots capable of accommodating a ball, (b) motor means for providing the roulette wheel with a spinning speed whose magnitude and/or direction are capable of being altered in such a manner that the ball is ejected from its slot and enters another one at random, (c) game selectors to select a slot upon which a player stakes, (d) a joker character display for each selector, with means to make the joker character appear or disappear at random on the joker character displays, (e) means to enable the joker shown in the display to be held at will, (f) a first plate which is attached to the roulette wheel so as to spin integrally therewith, said first plate having an indicator to show when said roulette wheel passes by zero, (g) a first signal transmitter/detector which is associated with said first plate and which is capable of detecting said indicator and transmitting a signal concerning detection of said indicator, (h) a second plate which is attached to the roulette wheel so as to spin integrally therewith, said second plate capable of providing a signal for each said slot around the roulette wheel, (i) a second signal transmitter/detector which is associated with said second plate and which is capable of detecting said signals from said second plate and transmitting a signal concerning said signal from said second plate, (j) a third transmitter/detector to detect the presence of the ball in a slot, (k) a processor equipped with means to receive the signal from the first transmitter/detector to denote passage by zero, and also to receive the signals from the second tranmitter/detector and identify them with the relevant slot, and moreover to receive data from the third transmitter/detector to detect presence of the ball, and to award a prize if the position of the ball coincides with the slot upon which the player's stake has been placed by means of preselection on the game selector.

2. The apparatus of claim 1 further comprising a fourth transmitter/detector that is identical to the third transmitter/detector and spaced at an angle thereto, whereby the processor decides on the basis of the same data being output from both the third and fourth tranmitter/detectors the position of the ball.

3. The apparatus of claim 1 wherein the roulette wheel comprises a main body in which are located the slots for accommodating the ball, and a running rim which surrounds said main body, said running rim having an outer body, the inner surface of which is steeply banked and surrounds said main body.

4. The apparatus of claim 3 wherein the outer body is stationary.

5. The apparatus of claim 1 further comprising a display to show the number of games remaining to be played, a display to show that the machine is ready to play, and a display to denote that the machine will not accept any further stakes.

6. The apparatus of claim 1 wherein the joker processor awards extra prizes when the character held coincides with the game selector upon which the stake has been placed and which has been awarded a prize.

7. The apparatus of claim 1 further comprising a display to denote the slot in which the ball has come to rest.

* * * * *

UNITED STATES PATENT AND TRADEMARK OFFICE

CERTIFICATE OF CORRECTION

PATENT NO. : 4,732,385

DATED : March 22, 1988

INVENTOR(S) : Rodolfo B. Castellanos

It is certified that error appears in the above-identified patent and that said Letters Patent are hereby corrected as shown below:

Column 6, line 4, delete "joker".

Column 6, line 5, insert --joker-- before "character".

Signed and Sealed this

Twenty-fifth Day of October, 1988

*Attest:*

DONALD J. QUIGG

*Attesting Officer*

*Commissioner of Patents and Trademarks*